US006862766B2

(12) United States Patent
Geurts

(10) Patent No.: US 6,862,766 B2
(45) Date of Patent: Mar. 8, 2005

(54) HAND TOOL FOR EXPANDING PIPE ENDS AND PRESSING SLEEVES ONTO FITTINGS

(75) Inventor: Dennis G. Geurts, Paynesville, MN (US)

(73) Assignee: Malco Products, Inc., Annandale, MN (US)

( * ) Notice: Subject to any disclaimer, the term of this patent is extended or adjusted under 35 U.S.C. 154(b) by 99 days.

(21) Appl. No.: 10/123,926

(22) Filed: Apr. 16, 2002

(65) Prior Publication Data

US 2003/0204943 A1 Nov. 6, 2003

(51) Int. Cl.[7] ..... B25F 1/00
(52) U.S. Cl. ..... 7/157; 72/317; 29/268
(58) Field of Search ..... 7/157; 29/235, 29/237, 268, 280, 282; 72/317

(56) References Cited

U.S. PATENT DOCUMENTS 1,085,461 A * 1/1914 Michaelis ..... 29/268
3,812,704 A 5/1974 Kowal
4,212,186 A 7/1980 Blattler
4,257,135 A * 3/1981 Moebius ..... 72/317
4,733,551 A 3/1988 Bryant et al.
6,334,351 B1 1/2002 Tsuchiya

OTHER PUBLICATIONS

Printout of search results, dated Mar. 1, 2002.
Rehau brochure, "Raupex Hydronic Heating Systems".
Rehau Product Catalog, "Raupex Heating and Plumbing Systems", pp. 40–42.
Rehau brochure in German.
Web page from Rehau website, dated Oct. 23, 2000.
Rehau instruction sheet for Everloc Hand Tools.

* cited by examiner

*Primary Examiner*—James G. Smith
(74) *Attorney, Agent, or Firm*—Gerald E. Helget; Nelson R. Capes; Briggs and Morgan, P.A.

(57) ABSTRACT

A hand tool for expanding an end of a pipe to insert a fitting therein and for pressing a retaining sleeve over the pipe and fitting. The tool includes: (a) a replaceable, expandable head for insertion within an end of the pipe; and (b) a gripping and pressing member to grip the fitting and the retaining sleeve and to press the retaining sleeve over the pipe and fitting.

8 Claims, 4 Drawing Sheets

HAND TOOL FOR EXPANDING PIPE ENDS AND PRESSING SLEEVES ONTO FITTINGS

BACKGROUND OF THE INVENTION

The present invention relates to a hand tool for expanding an end of a pipe preparatory to inserting a fitting therein, and then pressing a retaining sleeve over the joined pipe and fitting.

Pipe expanders are known in the art. For example, U.S. Pat. No. 4,733,551 shows a pipe expander that uses a pin with a tapered end, driven axially into the end of a pipe, to drive an expander head radially outward against the inside surface of a cylindrical pipe, thereby expanding the pipe radially.

One problem with pipe expanders of the type shown in the '551 patent is that the expander head is not easily removed for replacement with another expander head suitable to a pipe with a different inside diameter. The expander head of the '551 patent is bolted to a front plate of the tool by bolts 46, which must be removed to change the expander head.

A different type of pipe expander is marketed by Rehau, Inc., P.O. Box 1706, Leesburg, Va. 20177. This type of pipe expander is used with Rehau's proprietary EVERLOC® fittings and RAUPEX® cross-linked polyethylene pipe. As can be seen in FIG. 1, an EVERLOC® fitting F is inserted into an end of the RAUPEX® pipe P after the pipe P is expanded by the pipe expander. The nature of the RAUPEX® material is that it returns to its original shape after being expanded, thereby gripping the inserted fitting. The pipe expander utilizes interchangeable expander heads that are easily screwed on and off of the tool.

Next, as seen in FIG. 2, a proprietary EVERLOC® sleeve S is pressed over the end of the pipe P containing the fitting F, thereby further securing the pipe and fitting. A second proprietary tool, marketed by Rehau, known as a manual compression tool, is used to compress the sleeve onto the pipe and fitting.

A problem with the Rehau EVERLOC® system is that two separate tools are needed to complete the joint: a pipe expander to expand the pipe, and a separate compression tool to compress the sleeve onto the pipe and fitting.

A second problem with the Rehau system is that both the pipe expander and the manual compression tool are large, bulky, and require two hands for operation. Because of the large size, they cannot easily be used with pipes that are in close apposition to a wall or floor. Also, they are too large to be easily carried on a workman's tool belt.

There is a need for a hand tool that addresses the above problems. The tool should allow one-handed operation, be small enough to carry on a tool belt, and have easily interchangeable heads.

SUMMARY OF THE INVENTION

A hand tool for expanding an end of a pipe to insert a fitting therein and for pressing a retaining sleeve over the pipe and fitting, the tool comprising:

(a) a replaceable, expandable head adapted for insertion within an end of the pipe; and (b) a gripping and pressing member adapted to grip the fitting and the retaining sleeve and to press the retaining sleeve over the pipe and fitting.

A principal object and advantage of the present invention is that it allows one handed operation.

A second principal object and advantage of the present invention is that it combines the features of two separate tools into one tool.

Another object and advantage of the present invention is that it is small enough to carry on a tool belt.

Another object and advantage of the present invention is that it includes easily interchangeable heads to expand pipes of various internal diameters.

BRIEF DESCRIPTION OF THE DRAWINGS

FIG. 7 is cross-section of the tool of the present invention.

DETAILED DESCRIPTION OF THE PREFERRED EMBODIMENT

Figures 1, 2, 4:
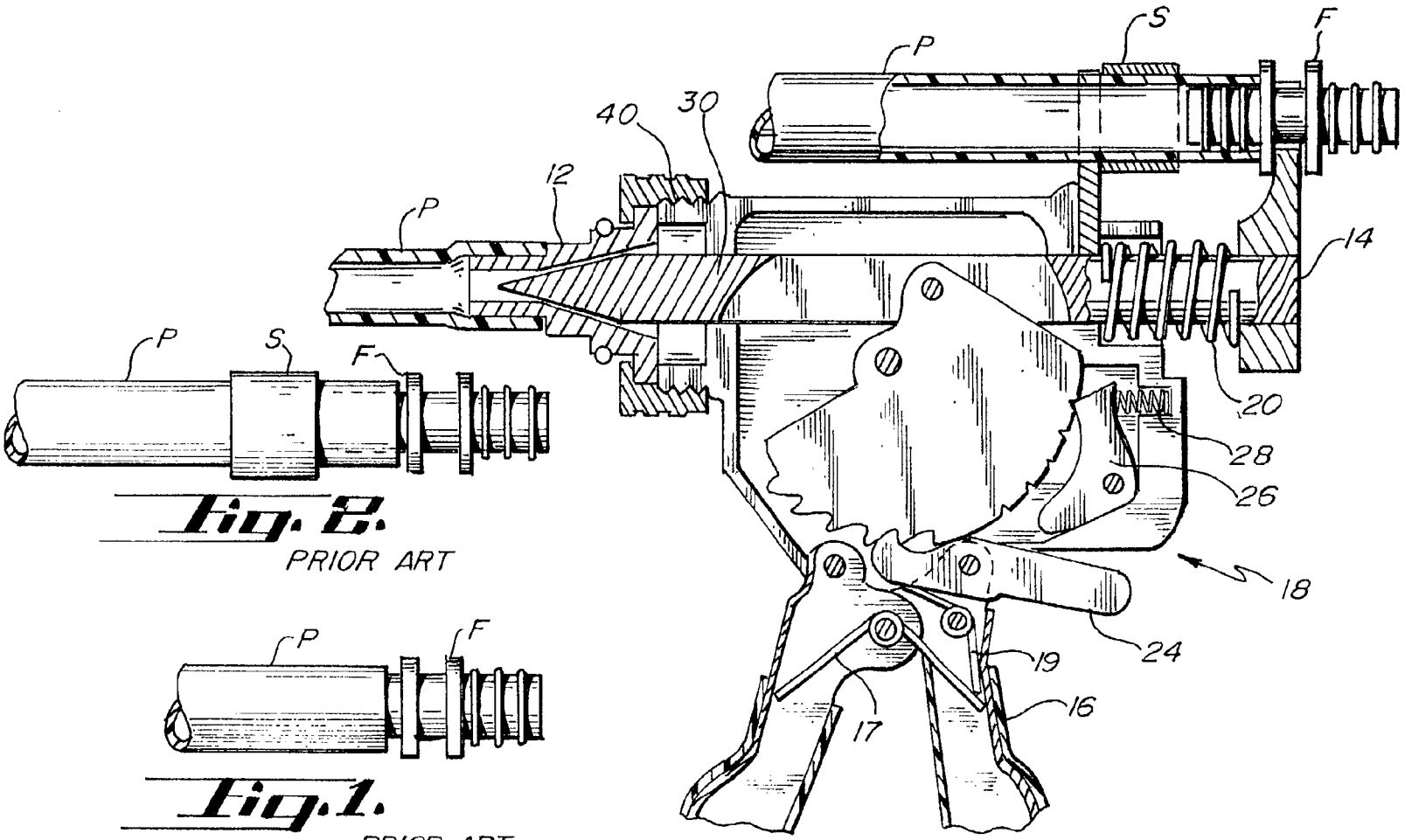
fig. 2. PRIOR ART
fig. 1. PRIOR ART
FIG. 1 is view of a pipe and fitting of the prior art.
FIG. 2 is a view of a pipe, fitting, and sleeve of the prior art.
FIG. 4 is a perspective view of the tool of the present invention with the workpiece shown in phantom.
Figure 3:
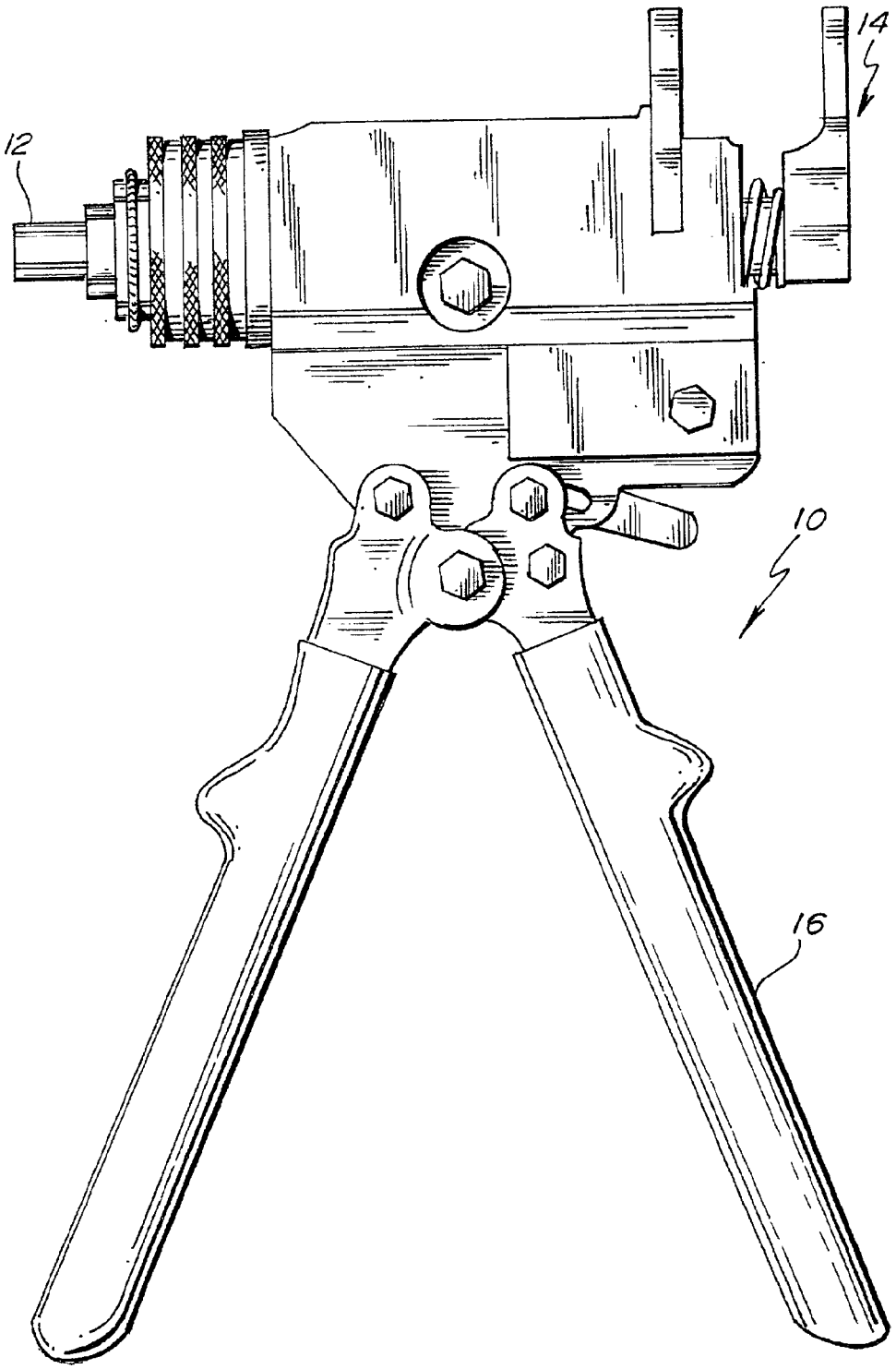
FIG. 3 is an elevational view of the tool of the present invention.
Figure 4:
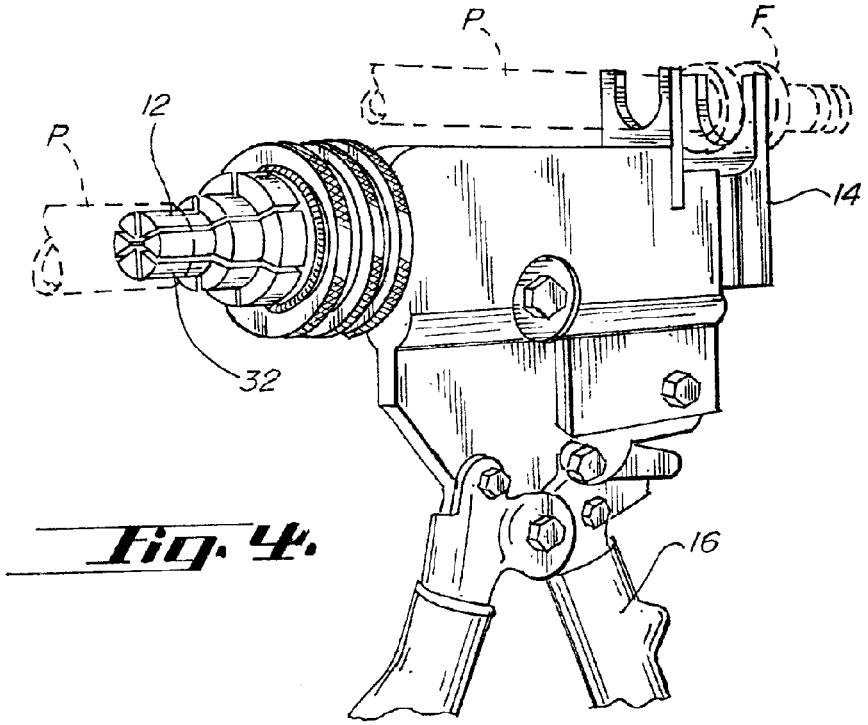

The hand tool of the present invention is generally shown in the Figures as reference numeral 10.

The hand tool 10 is used for expanding an end of a pipe P as to insert a fitting F therein. The same tool 10 is also used for pressing a retaining sleeve S over the pipe P and fitting F to secure the fitting F within the pipe P.

The hand tool 10 comprises a replaceable, expandable head 12 adapted for insertion within an end of the pipe P and a gripping and pressing member 14 adapted to grip the fitting F and the retaining sleeve S and to press the retaining sleeve S over the pipe P and fitting F.

The hand tool 10 preferably further comprises an operating handle 16 driving the head 12 and the gripping and pressing member 14. Most preferably, the operating handle 16 simultaneously drives the head 12 and gripping and pressing member 14. In this aspect, the tool allows a pipe to be expanded at one end while a fitting is simultaneously pressed at the other end or at an end of another pipe. The operating handle may have torsion spring 17 that is biased against squeezing of the handle 16.

The hand tool 10 also preferably further comprises a ratchet 18 cooperating with the operating handle 16 to permit incremental expansion of the expandable head 12 and incremental operation of the gripping and pressing member 14. A spring 20 opposes motion of the ratchet 18.

The ratchet 18 preferably further comprises a toothed gear 22, a hinged pawl 24 driven by the operating handle 16, and a dog 26 permitting rotation of the toothed gear in one direction only. The torsion spring 17 preferably acts on the pawl 24 to cause the pawl 24 to pivot as the handle 16 is squeezed. A second spring 28 biases the dog 26 against the toothed gear 22. A spring 19 biases the pawl 24 against the gear 22.

To expand the head 12, the tool 10 may preferably further comprise a tapered pin 30 that slidingly engages the head 12 to cause expansion of the head 12 as the tapered pin 30 is slid axially into the head 12. The head 12 preferably is comprised of independent segments 32 that expand apart as the pin 30 is slid axially into the head 12.

As noted above, the head 12 is replaceable. For easy replacement, the head 12 may screw onto the hand tool by threads 40 as shown.

Figure 8:
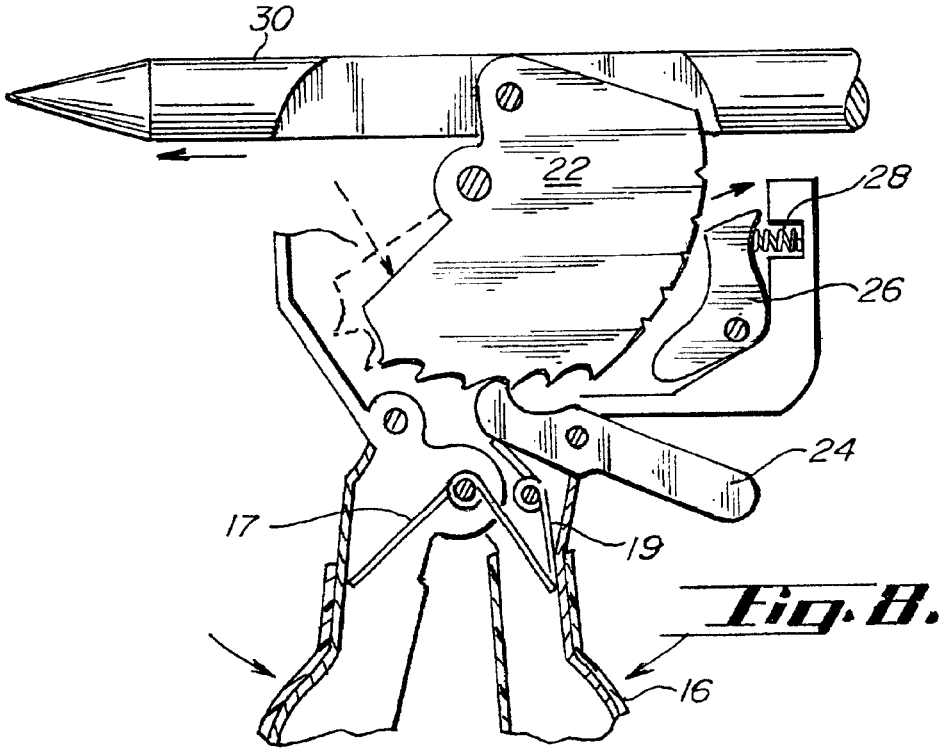
FIGS. 8 and 9 are detailed cross-sections showing the details of the ratchet of the present invention.
Figure 9:
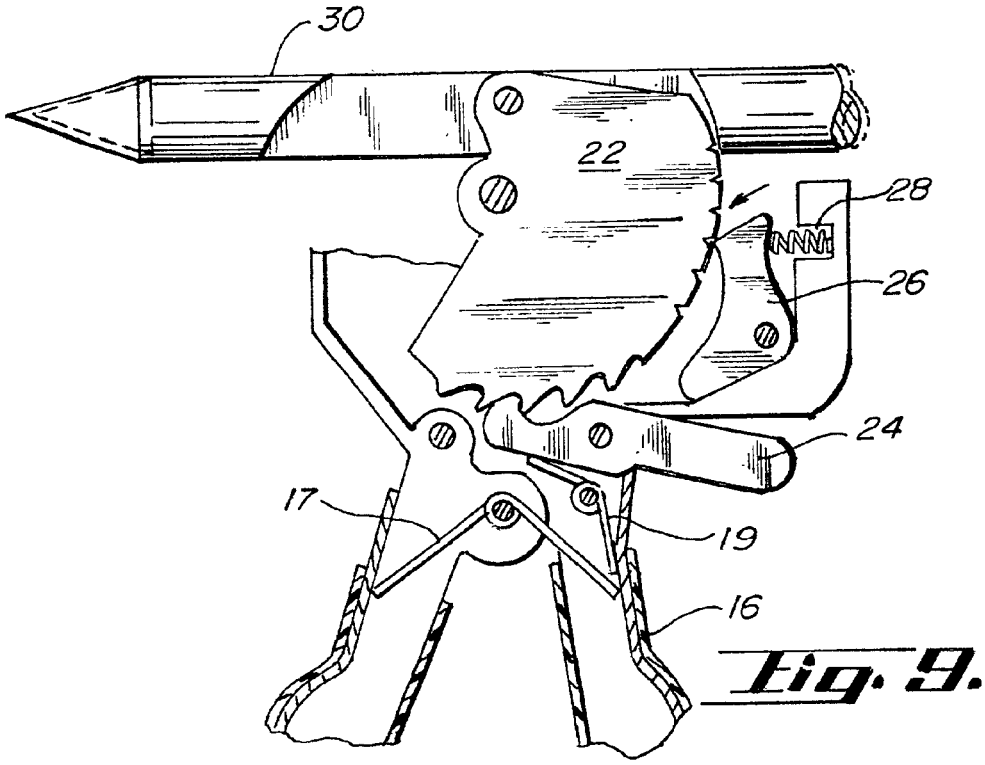

Operation of the tool is shown in FIGS. 8 and 9. As the handle 16 is squeezed, the pawl 24 is caused to pivot. Because the pawl 24 engages the toothed gear 22, the gear 22 is driven in counterclockwise rotation, causing the tapered pin 30 to be driven in the direction shown by the arrow, axially into the expanding head 12.

When the handle is released, the pawl 24 rotates in the opposite direction, with the end engaging the gear 22 sliding into the next gear tooth. The torsion spring 19 keeps the pawl biased against the gear. Reverse rotation of the gear 22 is prevented by the dog 26 and spring 28.

Figure 5:
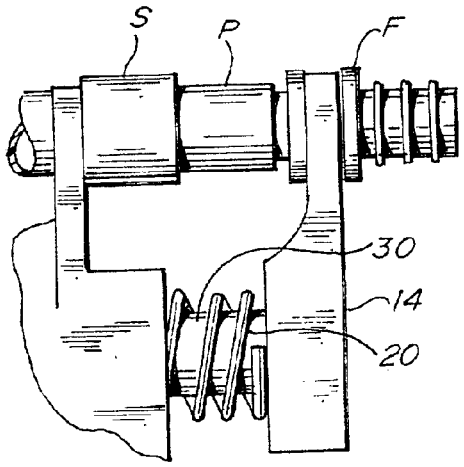
FIGS. 5 and 6 are detailed views of the gripping and pressing member of the present invention.
Figure 6:
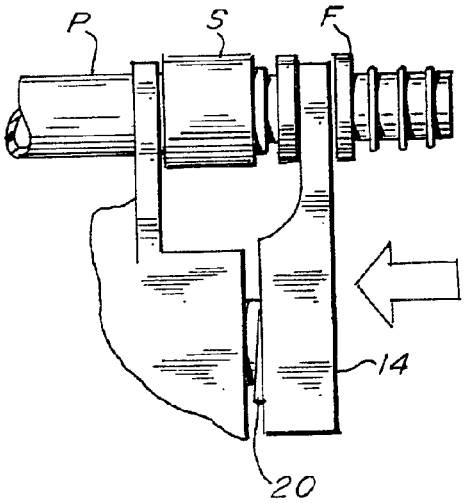

Operation of the gripping and compressing member 14 is shown in FIGS. 5 and 6. As the handle 16 is squeezed, movement of the pin 30 as previously described causes the member 14 to move in the direction of the arrow, against the bias of spring 20. This causes the pipe P and fitting F to be pressed within the sleeve S as shown.

To reset the tool, the pawl 24 is rotated by hand counterclockwise, thereby releasing the gear 22, causing the spring 20 to move the pin 30 away from the head 12 and to move the member 14 away from the fitting F.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A hand tool for expanding an end of a pipe to insert a fitting therein and for pressing a retaining sleeve over the pipe and fitting, the tool comprising:

(a) a replaceable, expandable head adapted for insertion within an end of the pipe;

(b) a gripping and pressing member adapted to grip the fitting and the retaining sleeve and to press the retaining sleeve over the pipe and fitting; and (c) an operating handle operating the head and the gripping and pressing member wherein the operating handle simultaneously drives the head and the gripping and pressing member.

2. The hand tool of claim 1, further comprising a ratchet cooperating with the operating handle to permit the incremental expansion of the expandable head and incremental operation of the gripping and pressing member, and a spring opposing the motion of the ratchet.

3. The hand tool of claim 2, wherein the ratchet further comprises a toothed gear, a hinged pawl driven by the operating handle, and a dog permitting rotation of the toothed gear in one direction only.

4. The hand tool of claim 1, further comprising a tapered pin slidingly engaging the head and causing expansion of the head as the tapered pin is slid axially into the head.

5. The hand tool of claim 1, wherein the expandable head can be screwed onto the hand tool.

6. A hand tool for expanding an end of a pipe to insert a fitting therein and for pressing a retaining sleeve over the pipe and fitting, the tool comprising (a) a replaceable, expandable head adapted for insertion within an end of the pipe;

(b) a gripping and pressing member adapted to grip the fitting and the retaining sleeve and to press the retaining sleeve over the pipe and fitting;

(c) an operating handle simultaneously operating the head and the gripping and pressing member;

(d) a ratchet cooperating with the operating handle to permit incremental expansion of the expandable head and incremental operation of the gripping and pressing member, and a spring opposing the motion of the ratchet; and (e) a tapered pin slidingly engaging the head and causing expansion of the head as the tapered pin is slid axially into the head.

7. The hand tool of claim 6, wherein the ratchet further comprises a toothed gear, a hinged pawl driven by the operating handle, and a dog permitting rotation of the toothed gear in one direction only.

8. The hand tool of claim 6, wherein the expandable head can be screwed onto the hand tool.

* * * * *